United States Patent [19]

Pausing

[11] Patent Number: 4,844,327

[45] Date of Patent: Jul. 4, 1989

[54] PACK FOR FLUID MEDIA

[75] Inventor: Hans Rausing, Wadhurst, Great Britain

[73] Assignee: Tetra Pak Finance & Trading S.A., Pully, Fed. Rep. of Germany

[21] Appl. No.: 268,664

[22] Filed: Nov. 4, 1988

Related U.S. Application Data

[63] Continuation of Ser. No. 931,637, Nov. 17, 1986, abandoned.

[30] Foreign Application Priority Data

Nov. 19, 1985 [GB] United Kingdom ..... 8528441

[51] Int. Cl.[4] ..... B65D 5/06

[52] U.S. Cl. ..... 229/5.5; 229/106; 229/110; 229/48 T; 229/125.15; 229/DIG. 9; 264/251; 493/114; 493/122; 493/157

[58] Field of Search ..... 229/109, 110, 4.5, 5.5, 229/485 A, 48 T, 49, 106, 123.2, 125.09, 125.11, 125.14, 125.15, 125.17, DIG. 9, 125.42; 222/528, 556, 557, 559, 560; 264/251, 252; 493/114, 128, 156, 157

[56] References Cited

U.S. PATENT DOCUMENTS

| | | | |
|---|---|---|---|
| 901,695 | 10/1908 | Davis | 229/109 |
| 1,236,444 | 8/1917 | Jones | 229/DIG. 9 |
| 2,377,533 | 6/1945 | Waters | 229/16 R |
| 2,432,462 | 12/1947 | Waters | 229/48 T |
| 2,673,024 | 3/1954 | Kuss | 229/110 |
| 2,801,040 | 7/1957 | Meyer-Jagenberg et al. | 229/7 R |
| 3,001,207 | 9/1961 | Nail | 493/157 |
| 3,286,902 | 11/1966 | Hunter et al. | 229/7 R |
| 3,351,260 | 11/1967 | Koolnis | 229/17 R |
| 3,450,331 | 6/1969 | Tapiovaara | 229/110 |
| 3,511,902 | 5/1970 | Santangelo | 264/251 |
| 4,217,326 | 8/1980 | Goralnik | 264/251 |
| 4,332,345 | 6/1982 | Moran | 229/184 |
| 4,564,139 | 1/1986 | Reil | 229/7 R |
| 4,669,640 | 6/1987 | Ando et al. | 222/556 |

FOREIGN PATENT DOCUMENTS

| | | | |
|---|---|---|---|
| 683354 | 3/1964 | Canada | 206/631 |
| 872149 | 5/1942 | France | 229/49 |

*Primary Examiner*—David T. Fidei
*Assistant Examiner*—Gary E. Elkins
*Attorney, Agent, or Firm*—Paul & Paul

[57] ABSTRACT

A pack for fluid media, comprising a tube (1) forming side walls (2, 3) as well as a cover (5) and a base, which cover and base are fitted to end edges (4) of the tube (1) is provided. At least the side walls (2, 3) and the base are made of plastics-coated carrier material incorporating paper, cardboard or the like, and the base is formed by folded-over wall panels which are formed integrally with the tube (1), providing two mutually oppositely disposed double-walled triangular panels which are in communication with the interior of the pack. The cover (5) is also formed by folded-over wall panels (6) which are formed integrally with the tube (1) and edges (7) of the wall panels (6) are fluid-tightly connected together by injected bridges (8) of plastics material.

14 Claims, 3 Drawing Sheets

PACK FOR FLUID MEDIA

Figure 1:
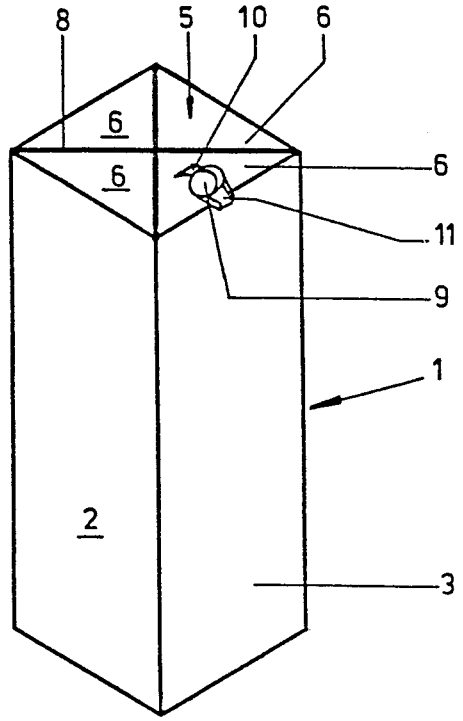

This is a continuation of co-pending application Ser. No. 931,637 filed on Nov. 17, 1986, abandoned.

This invention relates to a pack for fluid media, in the form of a tube providing side walls, a cover and a base. The cover and base are fitted to or located at the end edges of the tube. At least the side walls and the base comprise plastics-coated carrier material incorporating paper, cardboard or the like, and the base is formed by folded-over wall panels which are formed integrally with the tube, providing two mutually oppositely disposed double-walled triangular panels which are in communication with the interior of the pack.

Many one-trip or single use packs incorporating plastics-coated paper as a carrier material, hereinafter referred to as paper for the sake of brevity, are known for the purposes of packaging flowing media, in particular milk, juice and water. Such paper packs have also a large number of different configurations, such as cubes, parallelepipedic containers etc., wherein the base is generally flat and the cover either projects at the top of the tube out of the notional horizontal surface which is parallel to the bottom, or the cover lies in the upper end surface and is also flat. The flat base is desirable for stability and rigidity and ease of use by the final consumer. There are flat covers which project out of the upper horizontal end surface, for example in the case of a gable-like folding closure; and there are also covers which are made only of plastics material, without any carrier material, which are injected or injection moulded on the upper edge of the tube. Here too there are various known configurations of cover, in particular flat and conical covers.

In the production of an inexpensive fluid pack which is satisfactorily fluid-tight but which is nonetheless easy to open, a certain level of expenditure in terms of manufacturing procedure or in relation to material requirement has been inevitable. Expenditure in respect of material includes, for example, additional sealing strips which are fitted into position in a very wide range of forms from the inside or the outside of the cover, and there sealed in place. Expenditure in respect of manufacturing procedure is for example the use of larger machines for setting up particular injection moulds. Here however highly advantageous packs which are desirable from the point of view of the final consumer, in particular with a cover which is injected in position and which comprises plastics material, have already been produced.

Nevertheless there is a need for further improvement in the abovementioned fluid packs which are already quite good, because improvements can still be achieved, for example, in savings on material and gas-tightness.

Although, when forming a cover by injection of plastics material, it is possible to make a saving in avoiding use or paper material for the cover, the plastics material for producing the cover is generally more expensive. It has also been found that plastics materials which can be easily injected are not gas-tight with a comparable level of quality as the plastics-coated papers which are generally used nowadays when packaging fluids. Gas-tightness can be improved by injecting thicker wall panels, but this gives rise to problems of additional expenditure on material and increased weight.

There is thus the need further to develop a pack for flowing or fluid media which can provide simple closure of the tube with the minimum possible use of material while nonetheless providing good gas-tightness. Preferably handling of the pack is to be made easy from the point of view of the final consumer whilst opening or possibly even re-closing of the pack should be an easy operation to perform.

According to the present invention there is provided a pack for fluid media, in the form of a tube providing side walls, a cover and a base wherein at least the side walls and the base are made of plastics-coated carrier material incorporating paper, cardboard or the like, and the base is formed by folded-over walls panels, which are formed integrally with the tube, providing two mutually oppositely disposed double-walled triangular panels which are in communication with the interior of the pack, and wherein the cover is also formed by folded-over wall panels which are formed integrally with the tube, edges of said cover wall panels being fluid-tightly connected together by injected bridges or seams of plastics material.

The amount of plastics material required for producing such a cover is substantially less than that of a known pack in which the entire cover consists of plastics material without a carrier material. More specifically, it is only necessary for the gaps between the individual wall panels at the end edge of the tube, beside the cover, to be bridged or seamed over. Even if these plastics bridges are thicker than the known plastics cover, the total amount of plastics material used in forming the novel cover is still less. The plastics material for the above-mentioned bridges or seams should be such that it can be easily injected so that use should preferably be made of polyethylene, polystyrene or propylene. Because of the greater wall thicknesses for the plastics bridges, the gas-tightness of the novel cover is also better than in the case of a pack cover which only consists of plastics material forming or over the entire surface of the cover.

Another important advantage of the novel pack with the plastics bridges in the cover is that the advantages of a plastics cover arrangement are retained while achieving the advantages of using a smaller amount of material and enhanced gas-tightness. The advantages of the known plastics cover arrangement are inter alia that a pack provided with such a cover arrangement is better to open and is possibly also re-closable.

Manufacture of the pack according to the invention is also advantageous. The tube and the base are easy to form and to produce in sealed fashion, using conventional processes. In addition, the production of the cover does not require any particular punched-out portions, fold lines or the like which go beyond the usual punching and folding procedure. There are no critical locations for the welding operation and sealing the pack. The operation of injecting the bridges in position is carried out using the same tried and tested injection methods used for injecting a plastics cover on to a paper tube.

Even the consumption of paper can be optimised because virtually only that amount of paper which just covers the surface to be closed by the cover is used. Specifically, the wall panels which are formed integrally with the tube are provided at the side of the blank which subsequently forms the upper edge of the tube, in such a way that, after the tube has been formed, said wall panels provide the desired surface of the cover, almost 100%. It is advantageous in that respect for two blanks to be transported in opposite relationship to each other and in opposite directions to each other, in such a way that the wall panels of the one blank, which are formed integrally with the tube, are disposed directly adjacent to those of the other blank. In other words, the wall panels in question for forming the cover of the pack can be produced by a cut or a zig-zag cut line between the two blanks. Thus one cut (zig-zag line) forms two groups of oppositely disposed wall panels. This procedure thus gives rise to 'almost' no paper wastage.

If a butt-weld seam with a seam which is of a double-T-shape configuration in cross-section is used for producing the tube, it is actually possible for production to involve no paper wastage. If however the generally conventionally longitudinal seam which involves overlapping of two end edges is used for making up the tube of the pack, then beside a wall panel at the cover end of the tube, there is a small waste strip to compensate for the overlapping longitudinal seam. It is only in consideration of that construction that the 'almost' was used hereinbefore, for in that case also there is no paper wastage (except for the small compensating strip).

Depending on the embodiment used for making the tube, there is no paper waste or almost no wastage, and, as the expenditure on plastics material for the cover is low, the pack according to the invention can be produced with a minimum amount of material.

In a pack of the invention the edges of the plastics-coated wall panels of paper are disposed in closely juxtaposed relationship in the surface of the cover, leaving arrow gaps, and the plastics bridges are disposed in said gaps. Due to the above-mentioned cut line procedure for defining the paper wall panels, formed at the edges thereof are cut lines which have penetrated the plastics coating and which expose the carrier material, the paper, in an outward direction. When these wall panels are folded over in order to form the surface of the cover, then arrow gaps are formed, into which fluid should not penetrate because otherwise it would penetrate into the outwardly open carrier material which has pores, and could result in its being destroyed. In accordance with the invention however the plastics bridges are injected into precisely the above-mentioned gap. In that way any endangered cut line is covered over by plastics material, the individual wall panels are firmly and sealingly interconnected and in this way the arrangement has a stable overall surface as the cover, by using an injection process in which a mandrel on the inside and a co-operating mandrel on the outside of the cover ensure the precise configuration required.

When producing the, preferably, zig-zag line between the two blanks (in each case at the end of the tube which is towards the cover on each blank), gaps of greater or lesser width may be provided between the foldedover paper wall panels so that the plastics bridges which are injected into those gaps after the folding-over operation can be of greater or lesser thickness. Generally the gaps between the wall panels which are folded down into the surface of the cover are arrow and almost touching so. that the amount of plastics material to be used for the bridges to be injected remains at a low level.

It is also advantageous in accordance with the invention for the cover to be formed from at least four triangular wall panels. If precisely four triangular wall panels are disposed at the edge of the tube which is towards the cover, then it is possible in practice to form a pack which is quadrangular in cross-section, which is particularly good to grip across the diagonal, and which is particularly stiff. When a plurality of wall panels are provided, the outside contour of the cover may be arranged to be round. It will be appreciated that this involves an approximation for the fold edge of the wall panels remains more or less straight so that the surface of the cover is generally formed by a polygon. It will be appreciated that in exceptional cases it would also be possible to provide a rounded fold edge in order for the surface of the cover to be closed off at the outside by a round edge. In this case, at the points of contact between two juxtaposed wall panels, depending on the size thereof, there is a small raised portion, or the points of contact lie on small pointed portions. If the arrangement has a sufficient number of wall panels, that configuration can provide a particular, attractive design.

In general however it is desirable in accordance with the invention for the cover to be of a flat or conical configuration. In the case of a quadrangular or polygonal cover, the appropriate shaping of the wall panels permits them to be folded into one plane which is substantially normal to the centre line of the tube. With wall panels of a different configuration, if for example the upper tips thereof which meet at the centre of the surface of the cover after the folding-over operation are disposed at a greater distance from the fold edged, or in other words, if steep or high pointed triangular panels are formed, then that arrangement provides a conical surface.

In both cases of a possible cover surface or configuration thereof, it is advantageous in accordance with the invention for an opening means to be injected in the surface of the cover. It may be particularly advantageous for the opening means to be disposed in the middle of the cover. It is then injected on the abovementioned inner tips of the wall panels. For example, portions can be cut off at the upper or middle tips of the wall panels, in order to form an aperture or opening into which the above-mentioned opening means is injected and by means of which the material filling the pack may be poured out. However, even if the opening means is disposed at any location in the surface of the cover which is preferably also disposed closer to the edge, an opening may be formed, in accordance with the interior, by the opening means being injected into an aperture which is punched into at least one paper wall panel. A hole of any geometry may be punched in or cut out of the paper wall panel, on the inside or the outside, thereby producing at that location the above-mentioned aperture which on the one hand has plastics material injected around it, to form the opening means, and which on the other hand forms that opening through which the material filling the pack can be poured out. Due to the advantageous injection moulding procedure employed here different configurations of opening means can be used, for example opening means which involve re-closability, opening means with a pouring edge portion injected thereon, etc.

It is also desirable in accordance with the invention for a handle to be injection moulded on to the cover. That configuration is also guaranteed by virtue of using the practical injection moulding process. The inside and outside moulds of the injection moulding apparatus only need to be of a suitable configuration for a handle to be formed on the pack both in the region of the cover and possibly also in part on the outside of the tube, thereby engaging over the edge of the cover. It is also possible for gripping tongues or bar portions to be formed by injection moulding, for example on a tear-off membrane in the region of the opening means in order in particular to facilitate the operation of opening the pack and possibly also to provide for a re-closing effect. On the other hand however the handle on the cover may also be provided in such a way that the final user, before and/or after opening the fluid pack, and grip same and transport it by means of the handle. Particularly when the handle is formed in such a way as to extend over the tube, but also in the situation where the handle is only in the cover region, the handle can serve the facilitate pouring out material from the pack, for the purposes of tilting the pack.

If in another advantageous embodiment of the invention the tube has a longitudinal sealing seam, the same procedure can be used with paper wall panels for providing the cover, injecting material into the gaps to form plastics bridges, attaching opening means and possibly a handle, without giving rise to problems in regard to sealing the pack, even if the longitudinal sealing seam extends over the entire height of the tube into the tip of the triangular paper wall panel. Any fears on the last-mentioned possibility, if the longitudinal sealing seam is disposed in the paper wall panel for the purposes of forming the cover, have been found to be unjustified. When making the transfer from three layers or plies to one layer or ply, the injection moulding process can make critical locations into non-critical locations, without any problems in regard to sealing, and such non-critical locations consequently do not need to have particular attention paid to them.

Therefore, the particularly advantageous consideration in respect of the pack according to the invention lies in the saving of material and the well-sealed nature of the novel pack, being even gas-tight. The paper wall panels are so shaped and folded that there is only ever the desired surface of the cover that is covered, and there are no overlaps. Plastics is injection moulded around the material along the cut lines which provide the more or less elongate form of the triangular wall panels, and plastics material is injected into the cut lines or the gaps between adjacent wall panels. In practice the cut line is formed by being stamped or punched in the material, when severing two pack blanks which pass jointly through a machine. The punching or stamping and cutting operations may be carried out both on the paper producing machine and also in the packaging machine. Preferably the stamping or punching operation is carried out in the packaging machine because the latter can be more easily operated at the necessary operating cycle so that cutting and stamping can be performed more easily and waste can be removed more simply. Paper making machines however generally operate at very high output and at high speeds so that the cutting operations therein would require a greater amount of care to be taken.

Figure 2:
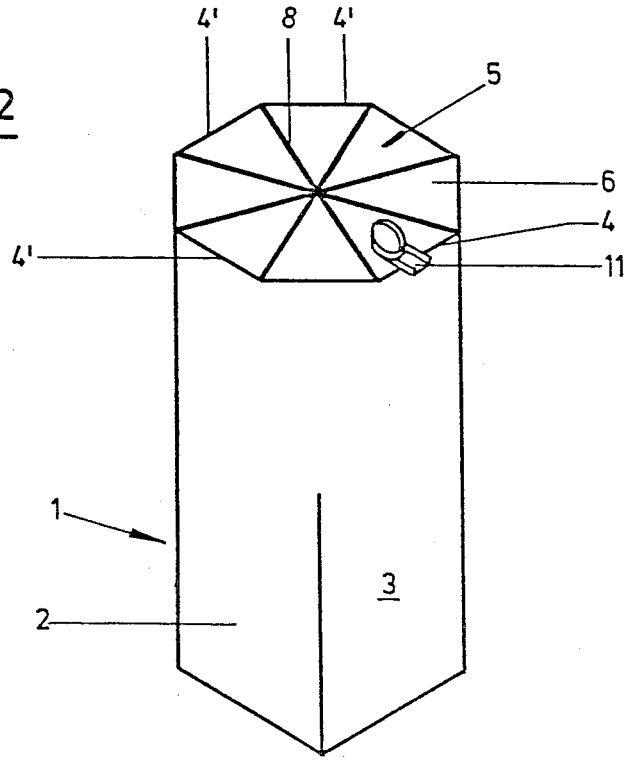
Figure 3:
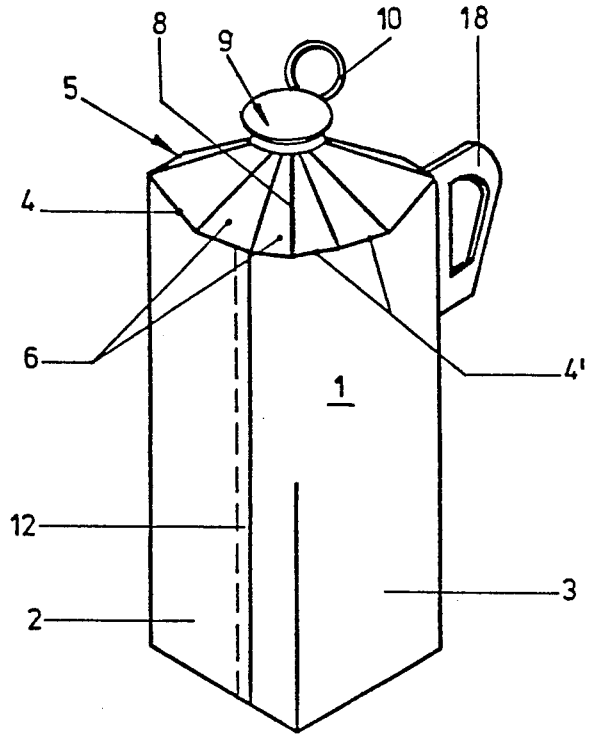
Figure 4:
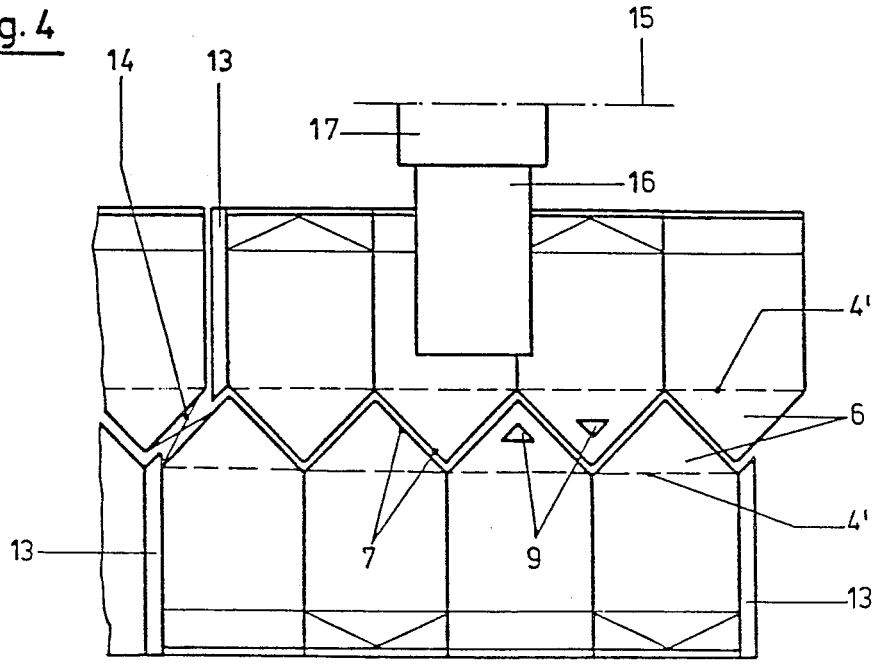
Figure 5:
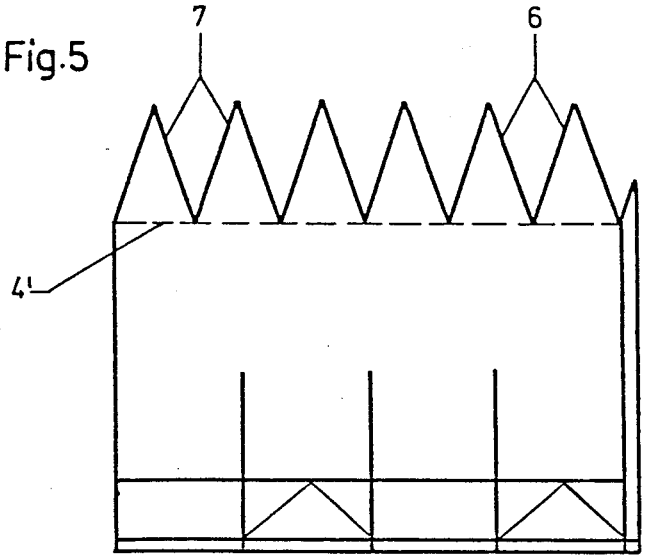
Figure 6:
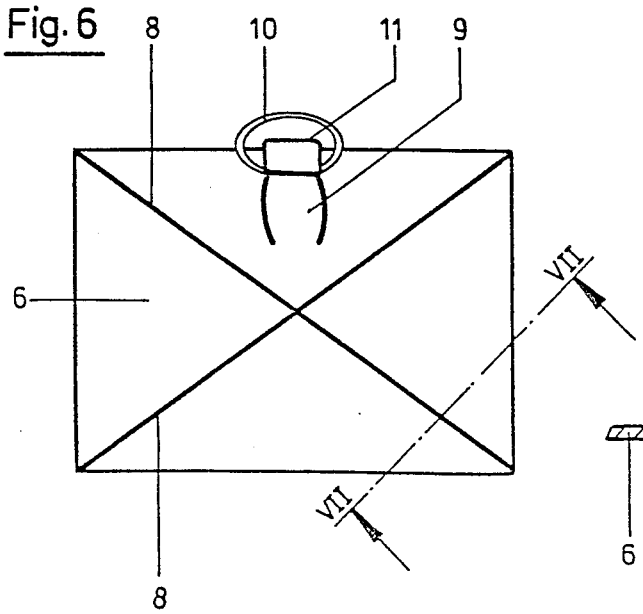
Figure 7:
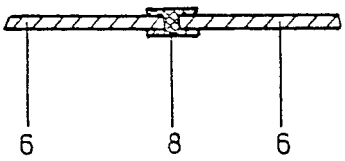

For a better understanding of the present invention, and to show how the same may be carried into effect, reference will now be made, by way of example to the accompanying drawings, in which:

FIG. 1 is a perspective view of a finished pack with a flat cover according to a first embodiment of the invention, FIG. 2 is a perspective view of a finished closed pack with a polygonal cover according to a second embodiment of the invention, FIG. 3 is a perspective view of yet another embodiment of the invention, showing a closed pack with frustoconical cover and a handle formed thereon, FIG. 4 is a plan view of two webs of blanks which move in mutually oppositely directed relationship, after the punching or stamping operation, FIG. 5 is a plan view of a separated individual blank for a conical cover, FIG. 6 is a plan view of a similar pack to that shown in FIG. 1, of quadrangular cross-section, and FIG. 7 is a broken-away diagrammatic sectional view taken along line VII—VII in FIG. 6.

One embodiment of the invention of a pack for fluid media is shown in perspective in FIGS. 1 to 3, having a tube generally referenced 1 and a base (not visible) which is of quadrangular configuration, thereby forming four side walls of which only front side walls 2 and 3 can be seen. A cover 5 is formed on the pack along the upper edge 4 of the tube 1. In the construction shown in FIGS. 1 and 2, the cover 5 is a flat surface while in the construction shown in FIG. 3 the cover provides a frustoconical surface.

In the embodiment shown in FIG. 1, the cross-section of the tube 1 is square, and both the base and the cover 5 are square. In the construction shown in FIG. 2, the tube 1 is square only in the lower portion, in the vicinity of the base, while the cover 5 is formed by a polygon. This also applies to the embodiment shown in FIG. 3. In the latter case also the upper edge 4 of the tube 1 which at the same time is also the connecting line of the fold edges 4', is a polygon in plan view.

The cover on each of the packs illustrated herein is formed from wall panels 6 which are in the form of triangles or, in the case of the embodiment shown in FIG. 3, trapeziums.

Due to the comparatively flat or short triangular wall panels in the embodiment shown in FIG. 1, the arrangement defines a cross when the fold-over flaps or wall panels 6 are folded inwardly about their fold lines 4' into the plane of the cover 5. In the folded-in condition as shown in FIGS. 1 to 3 the cut edges 7 at the edges of the wall panels 6 are disposed in closely side-by-side relationship so that they almost touch each other, while however leaving gaps into which the plastics bridges or seams indicated by reference numeral 8 are injected or injection moulded.

FIG. 7 shows a view on an enlarged scale and in cross-section of such a plastics bridge 8, between two adjacent wall panels 6. The illustrated bridge in this case is of a double-T-configuration, but it is also possible to envisage any other kind of configuration for the bridges 8.

In addition, in the illustrated embodiments of FIGS. 1 to 3 and 6, the pack has an opening means which is generally denoted by reference numeral 9. An opening tongue or bar portion 10 or also a pouring edge portion 11 for example may also be injection moulded thereon. FIG. 3 also shows a longitudinal sealing seam 12 in the form of an overlapping end edge of the tube material.

FIGS. 4 and 5 show mutually oppositely disposed blanks for the respective tubes, wherein shown at the end of each blank is an overlapping end edge 13 which is used for making up the longitudinal sealing seam 12. FIG. 4 particularly clearly shows the zig-zag punched or stamped line which is made up from the sum of the edges of the wall panels 6. It is only between two adjacent strip-like end edge panels 13 that there is a wastage portion 14 which is shown by a cross and which represents a periodically recurring wastage portion in the entire web of the double mutually oppositely disposed blanks. The usual fold lines for the conventional block bases are disposed at the outside on each blank, that is to say, in opposite relationship to the triangular wall panels 6.

Also shown in diagrammatic form in the upper part of FIG. 4, being rotatable about a centre line as indicated by a dash-dotted line at 15, is a mandrel 16 with holding portion 17, in order to show the way in which the blanks, after being separated off from each other, can be laid around the mandrel 16 in such a way that it provides the inner injection moulding portion. The wall panels 6 are laid on to the lower surface, as shown in FIG. 4, of the mandrel 16, by means of the fold lines 4', and in that position injected, thereby filling the gaps, with the bridges 8.

FIG. 5 shows a blank of another embodiment for a pack for a flowing medium, which blank has already been separated off from the web of material. In this case, the wall panels 6 are triangular and are greater in height than in the embodiment shown in FIG. 4. Further processing is carried out in the same manner as in relation to the other embodiments. The embodiment shown in FIG. 4 then gives for example the pack of which a perspective view is shown in FIG. 1 and whose cover is quadrangular and flat and can also have for example the construction shown in FIG. 6, with the opening means 9 with gripping tongue 10 and pouring edge portion 11.

I claim:

1. A pack for fluid media, in the form of a tube providing side walls, a cover and a base, wherein at least the side walls and the base are made of plastics-coated carrier material, and the base is formed by folded-over wall panels, which are formed integrally with the tube, providing two mutually oppositely disposed double-walled triangular panels which are in communication with the interior of the pack, and wherein the cover is also formed by non-overlapping folded-over wall panels which are formed intergrally with the tube, edges of said cover wall panels being fluid-tightly connected together by injected bridges or seams of plastics material, the injected seams of plastics material being sufficiently thick to provide a gas tightness at least as good as the gas tightness of the plastics-coated carrier material.

2. A pack according to claim 1, wherein the edges of the plastics-coated paper cover wall panels are disposed in closely juxtaposed relationship in the surface of the cover, leaving arrow gaps, and the plastics bridges or seams are disposed in said gaps.

3. A pack according to claim 1 or claim 2, wherein the cover is formed from at least four triangular wall panels.

4. A pack according to claim 1, wherein the cover is of flat or conical configuration.

5. A pack according to claim 1, wherein an opening means is provided in the surface of the cover.

6. A pack according to claim 5, wherein the opening means is disposed in the middle of the cover.

7. A pack according to claim 5, wherein the opening means is injected into an aperture which is punched into at least one paper wall panel.

8. A pack according to any one of claims 1 to 7, wherein a handle is provided on the cover.

9. A pack according to any one of claims 1 to 7, wherein the tube has a longitudinal sealing seam.

10. A pack according to claim 2 wherein the cover is formed from at least four triangular wall panels.

11. A method for making a pack for fluid media, the pack including side walls, a cover and a base, the method including:

(a) forming from a plastics-coated carrier material side walls and a first set and a second set of folded-over integrally formed wall panels;

(b) forming a base from the first set of wall panels to provide two mutually oppositely disposed double walled triangular wall panels which are in communication with the interior of the pack;

(c) positioning the second set of folded over wall panels so that the edges of the second set of folded over wall panels are disposed in closely juxtaposed relationship, leaving arrow gaps between the edges; and (d) filling the arrow gaps by injection molding of a plastics material to fluid-tightly connect the edges together to form seams in the cover, the seams being sufficiently thick to provide gas-tightness at least as good as the gas-tightness of the plastics-coated carrier material.

12. A method according to claim 11 wherein the side walls and first set and second set of wall panels comprise a blank punched from a web of plastics-coated carrier material, the method additionally comprising simultaneously punching at least two pack blanks from the web, a punched line between the two blanks forming the edges of the second set of wall panels of both blanks.

13. A method according to claim 12 additionally comprising positioning an interior injection mandrel proximate a blank, folding the second set of wall panels on the interior injection mandrel, and positioning an exterior injection molding mandrel proximate the second set of wall panels to provide cavities for injection molding of plastics material, the cavities including the cut edges of the second set of wall panels.

14. A pack for fluid media made by the method of claim 11.

* * * * *

UNITED STATES PATENT OFFICE

CERTIFICATE OF CORRECTION

Patent No. 4,844,327 Dated July 4, 1989

Inventor(s) Hans Rausing

It is certified that error appears in the above-identified patent and that said Letters Patent is hereby corrected as shown below:

Column 3, line 59, "arrow" should be --narrow--.

Column 8, line 29, "arrow" should be --narrow--.

Column 8, line 31, "arrow" should be --narrow--.

Signed and Sealed this

Seventeenth Day of April, 1990

*Attest:*

HARRY F. MANBECK, JR.

*Attesting Officer*

*Commissioner of Patents and Trademarks*